US009199768B1

(12) United States Patent
Casey

(10) Patent No.: US 9,199,768 B1
(45) Date of Patent: Dec. 1, 2015

(54) TWO-PIECE STOPPER

(71) Applicant: Ryan M. Casey, Pardeeville, WI (US)

(72) Inventor: Ryan M. Casey, Pardeeville, WI (US)

( * ) Notice: Subject to any disclaimer, the term of this patent is extended or adjusted under 35 U.S.C. 154(b) by 0 days.

(21) Appl. No.: 14/619,181

(22) Filed: Feb. 11, 2015

(51) Int. Cl.

| | |
|---|---|
| ***B01L 3/00*** | (2006.01) |
| ***B65D 39/00*** | (2006.01) |
| ***B65D 47/06*** | (2006.01) |
| ***A61J 1/14*** | (2006.01) |

(52) U.S. Cl.
CPC ..... *B65D 39/0076* (2013.01); *A61J 1/1412* (2013.01); *A61J 1/1475* (2013.01); *B01L 3/563* (2013.01); *B01L 3/565* (2013.01); *B65D 47/06* (2013.01); *B01L 2200/085* (2013.01); *B01L 2300/042* (2013.01)

(58) Field of Classification Search
CPC .... A61M 1/0001; B65D 47/06; A61J 1/1412; A61J 1/1475; A61J 2001/1481; A61J 2001/201
USPC ..... 215/307, 309, 364, 355; 220/801; 422/568, 570
See application file for complete search history.

(56) References Cited

U.S. PATENT DOCUMENTS

| | | | | |
|---|---|---|---|---|
| 34,227 | A * | 1/1862 | Ames | 215/364 |
| 2,802,587 | A | 8/1957 | Parvin | |
| 2,831,619 | A * | 4/1958 | Cowie | A45F 3/16 215/307 |
| 3,170,607 | A * | 2/1965 | Anthon | 222/400.7 |
| 3,195,757 | A * | 7/1965 | Creamer et al. | 215/307 |
| 3,282,457 | A | 11/1966 | Sirois | |
| 3,779,585 | A * | 12/1973 | Handzlik | 285/136.1 |
| 4,108,325 | A * | 8/1978 | Barre | 215/364 |
| 7,971,852 | B2 * | 7/2011 | Otsubo et al. | 251/144 |
| 8,714,383 | B2 | 5/2014 | Corson | |
| 2004/0238479 | A1 | 12/2004 | Caswell et al. | |

FOREIGN PATENT DOCUMENTS

| | | |
|---|---|---|
| WO | WO 03/095318 | 11/2003 |

* cited by examiner

*Primary Examiner* — Fenn Mathew
*Assistant Examiner* — James N Smalley
(74) *Attorney, Agent, or Firm* — Donald J. Ersler

(57) ABSTRACT

A two-piece stopper includes a stopper core and a stopper sleeve. The stopper core includes a core body, a top flange and a sleeve flange. The top flange is formed on a top of the core body and the sleeve flange is formed on a bottom thereof. At least one hole is formed through the core body to receive a glass tube or the like. At least one o-ring groove is formed in the at least one hole. An o-ring is inserted into each o-ring groove. A counterbore may be formed in the core body to receive a hose barb. The hose barb is threaded into the counterbore to retain a flexible tube. The stopper sleeve includes a cylindrical inner diameter and a tapered outer diameter. The stopper sleeve is retained between the top and the sleeve flanges. A second embodiment of the stopper utilizes the stopper sleeve only.

8 Claims, 3 Drawing Sheets

TWO-PIECE STOPPER

BACKGROUND OF THE INVENTION

1. Field of the Invention

The present invention relates generally to bottles and more specifically to a two-piece stopper for retaining items in a neck of a bottle.

2. Discussion of the Prior Art

Stoppers are used throughout laboratories to seal vessels such as flasks, bottles or tubes. The stoppers are often employed with multiple holes to allow the insertion of tubes for receiving and dispensing vessel contents or for thermometers. Stoppers are usually fabricated from rubber, and are sold as either solid or with holes (1-hole, 2-hole, or 3-hole). Solid stoppers can have holes bored or drilled to the correct size and quantity in the absence of pre-formed holes. Because of the multitude of possible hole sizes, quantities, and stopper size variations, a large inventory of different stoppers is often needed.

Several types of improved stoppers have been proposed—for example, U.S. Pat. No. 3,282,457 to Sirois (1966) discloses a stopper which has pre-formed holes capped by protruding plugs which can be removed via tearing and later reinserted if needed; commonly marketed today under the trademark "Twistit". However, if the hole size changes, the plugs will not properly seal. Once removed, the small plugs can be easily misplaced.

Forcefully inserting and removing glass tubing has also been a major problem as it can take significant force. This force can cause glass breakage, which can injury the user. If a mercury type thermometer is used, this can be an especially harmful and a costly concern. According to the CRC Handbook of Laboratory Safety, 5$^{th}$ Edition, by A. Keith Furr, "*Inserting glass tubing into stoppers or flexible plastic or rubber hoses is the source of one of the most common laboratory accidents with glass. Usually the cause is trying to force the tubing into the hole with no hand protection.*"

To help remedy this hazard, Parvin revealed through U.S. Pat. No. 2,802,587 (1957) a stopper which has tapered hole(s). Having a tapered hole can reduce the force necessary to insert or remove glass tubing. However, the tapered hole feature of this design is likely to limit the minimum possible spacing, and thus quantity and size of holes allowed in a stopper. Additionally, this design limits any possibility of plugging previously employed holes.

Finally, International Publication No. WO 03/095318 to Zeni discloses a composite stopper made of synthetic materials. Patent publication no. 20040238479 to Caswell discloses a stopper for bottle. U.S. Pat. No. 8,714,383 to Corson discloses a compound bung for wine and spirits.

Accordingly, there is a clearly felt need in the art for a two-piece stopper, which provides a better seal between an inner perimeter of a neck of a container and the two-piece stopper than that of the prior art, and decreases the chance of breaking glass tubing retained in the two-piece stopper.

SUMMARY OF THE INVENTION

The present invention provides a two-piece stopper, which provides a better seal between an inner perimeter of a neck of a container and the two-piece stopper. The two-piece stopper includes a stopper core and a stopper sleeve. The stopper core includes a core body, a top flange and a sleeve flange. The top flange is formed on a top of the core body and the sleeve flange is formed on a bottom of the core body. The stopper core is preferably fabricated from polytetrafluorethylene (PTFE), high-density polyethylene (HDPE) or a hard plastic material. However, other materials may also be used. At least one hole may be formed through the core body to receive a glass tube, a thermometer, a funnel or the like. At least one o-ring groove is formed in the at least one hole. An o-ring is inserted into each o-ring groove. The at least one o-ring minimizes the force exerted against a glass tube inserted into the at least one hole. A counterbore may be formed in the core body to receive a hose barb. The hose barb is threaded into the counterbore to retain a flexible tube.

The stopper sleeve includes a cylindrical inner diameter and a tapered outer diameter. The stopper sleeve is axially retained between the top flange and the sleeve flange of the core body. The stopper sleeve is preferably fabricated from silicone or any other suitable resilient material. A second embodiment of the stopper utilizes the stopper sleeve only. The stopper includes a tapered outer diameter and a cylindrical inner diameter. The cylindrical inner diameter is sized to receive an outer perimeter of a Buchner funnel, a large stem funnel or the like.

Accordingly, it is an object of the present invention to provide a two-piece stopper, which results in a better seal with an inner perimeter of a neck of a container than that of the prior art.

Finally, it is another object of the present invention to provide a two-piece stopper, which decreases the chance of breaking glass tubing retained in the two-piece stopper.

These and additional objects, advantages, features and benefits of the present invention will become apparent from the following specification.

DETAILED DESCRIPTION OF THE PREFERRED EMBODIMENTS

Figure 1:
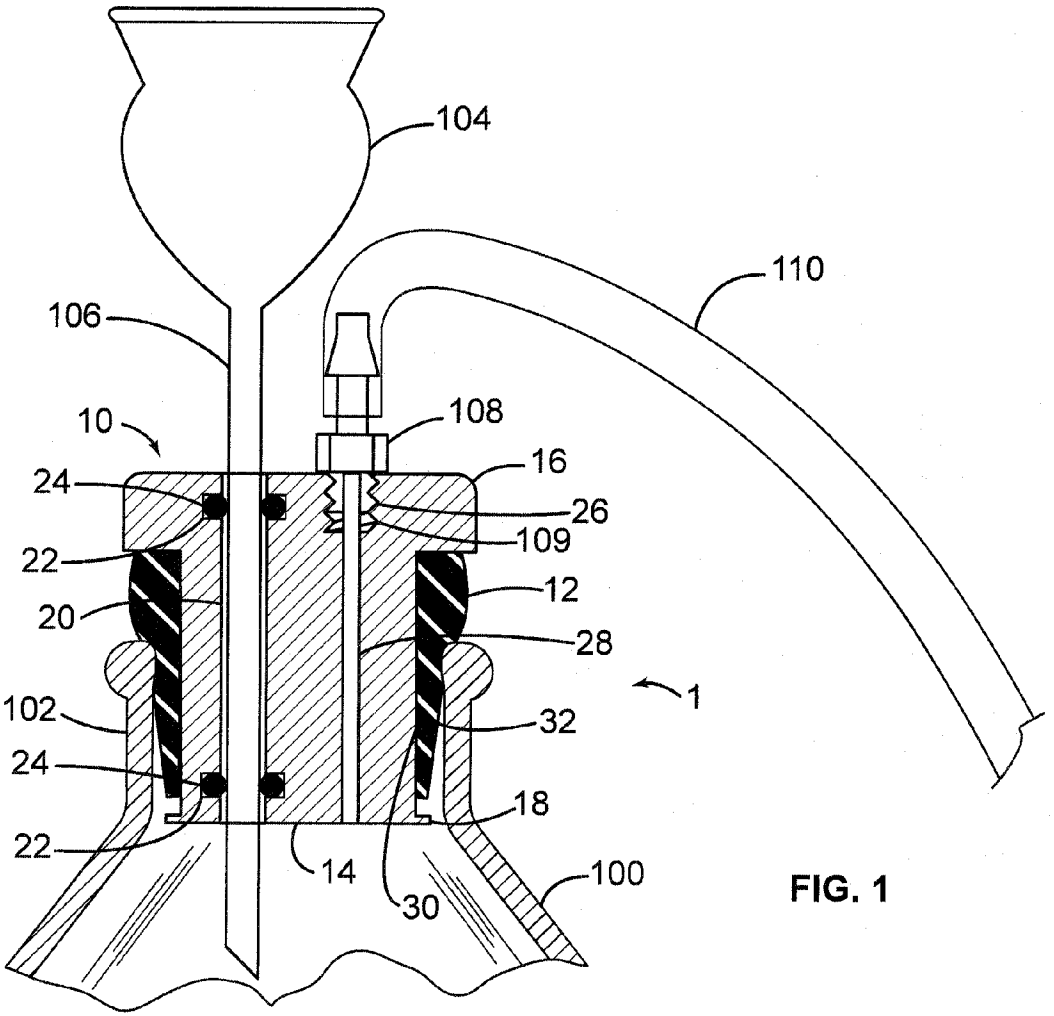
FIG. 1 is a cross sectional view of a two-piece stopper having a through hole with two o-rings retained in the through hole for retaining a cylindrical glass object and a counterbore for retaining a hose barb in accordance with the present invention.

With reference now to the drawings, and particularly to FIG. 1, there is shown a cross sectional view of a two-piece stopper 1 inserted into a neck 102 of a bottle 100. The two-piece stopper 1 includes a stopper core 10 and a stopper sleeve 12. The stopper core 10 includes a core body 14, a top flange 16 and a sleeve flange 18. The top flange 16 is formed on a top of the core body 14 and the sleeve flange 18 is formed on a bottom of the core body 14. The stopper core 10 is preferably fabricated from polytetrafluorethylene (PTFE), high-density polyethylene (HDPE), or a hard plastic material. However, other materials may also be used. At least one hole 20 may be formed through the core body 14 to receive a glass tube 106 of a funnel 104, a thermometer or the like. At least one o-ring groove 22 is formed in the at least one hole 20. The pair of o-ring grooves 22 are formed in a wall of the at least one hole 20. An o-ring 24 is inserted into each o-ring groove 22. The at least one o-ring 24 minimizes the force exerted against the glass tube 106 of the funnel 104, when inserted into the at least one hole 20.

A counterbore 26 may be formed in the core body 14 to receive a threaded end 109 of a hose barb 108. The counterbore 26 includes a through hole 28. The hose barb 108 is threaded into the counterbore 26 to retain a flexible tube 110. The core body 14 is inserted into the stopper sleeve 12. The stopper sleeve 12 includes a cylindrical inner diameter 30 and a tapered outer diameter 32. The stopper sleeve 12 is axially retained between the top flange 16 and the sleeve flange 18 of the core body 14. The stopper sleeve 12 is preferably fabricated from silicone or any other suitable resilient material.

Figure 2:
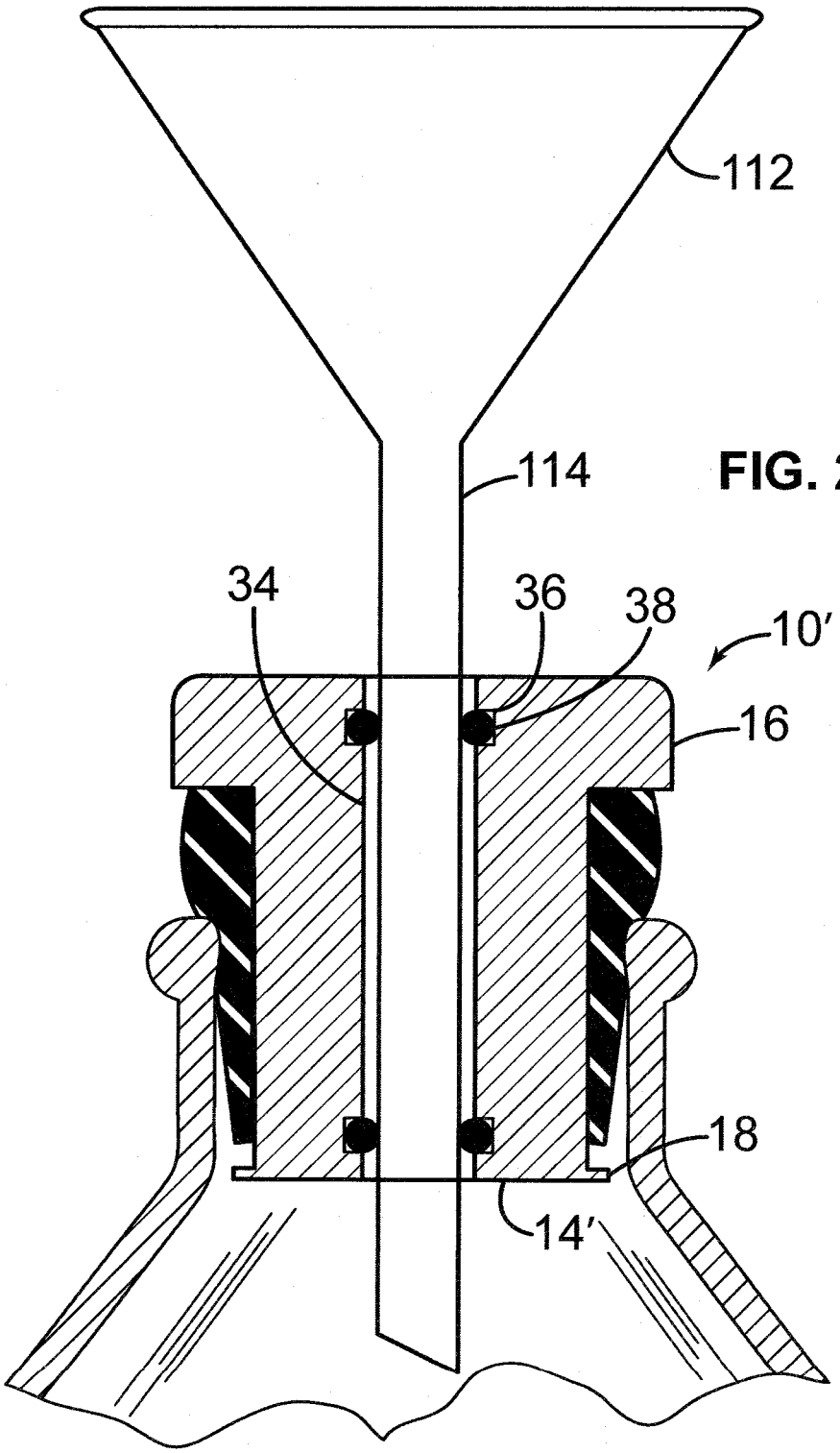
FIG. 2 is a cross sectional view of a two-piece stopper having a through hole with two o-rings retained in the through hole for retaining a funnel in accordance with the present invention.

With reference to FIG. 2, a two-piece stopper 1' includes a stopper core 10' and the stopper sleeve 12. The stopper core 10' includes a core body 14', the top flange 16 and the sleeve flange 18. A funnel hole 34 is formed through the core body 14' to receive a glass tube 114 of a funnel 112. At least one o-ring groove 36 is formed in the funnel hole 34. An o-ring 38 is inserted into each o-ring groove 36. The at least one o-ring 38 minimizes the force exerted against the glass tube 114 of the funnel 112, when inserted into the funnel hole 34.

Figure 3:
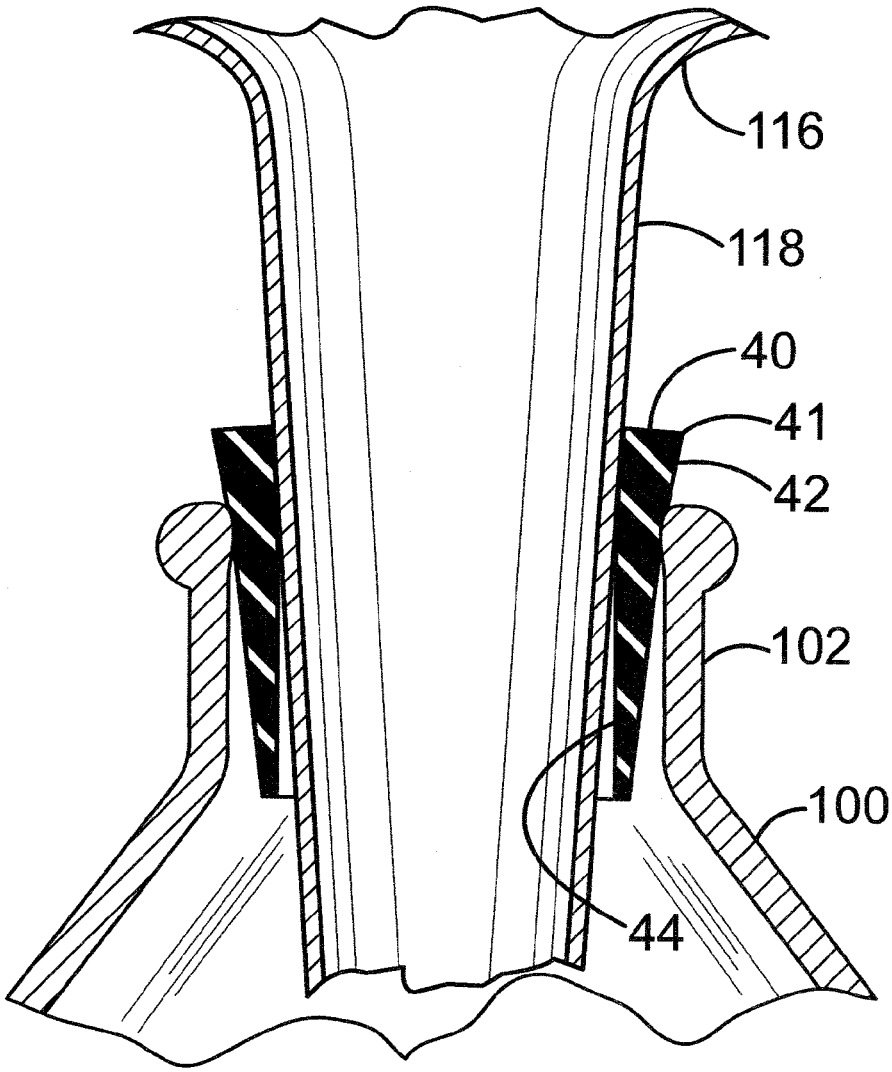
FIG. 3 is a cross sectional view of a stopper retaining a Buchner funnel in accordance with the present invention.

With reference to FIG. 3, a second embodiment of the stopper utilizes the stopper sleeve 40. The stopper sleeve 40 includes a stopper body 41. The stopper body 41 includes a tapered outer diameter 42 and a cylindrical inner diameter 44. The cylindrical inner diameter 44 is sized to receive a conical tube portion 118 of a Buchner funnel 116, a large stem funnel or the like. The tapered outer diameter is sized to be inserted into the neck 102 of the bottle 100. A perimeter of the tapered outer diameter 42 is greater at a top than at a bottom.

While particular embodiments of the invention have been shown and described, it will be obvious to those skilled in the art that changes and modifications may be made without departing from the invention in its broader aspects, and therefore, the aim in the appended claims is to cover all such changes and modifications as fall within the true spirit and scope of the invention.

I claim:

1. A two-piece stopper for insertion into a neck of a bottle, comprising:

a stopper core includes a core body, a top flange and a sleeve flange, said top flange is formed on a top of said core body, said sleeve flange is formed on a bottom of said core body;

a stopper sleeve includes a cylindrical inner diameter and a conical outer diameter, a proximal end of said conical outer diameter has a greater circumference than a distal end of said tapered outer diameter, said stopper sleeve is fabricated from a resilient material, wherein said stopper core is inserted into said inner diameter, said stopper sleeve is axially retained between said top flange and said sleeve flange; and a counterbore is formed in said core body, a through hole of said counterbore extends completely through said core body, a threaded end of a hose barb is threadably engaged with said counterbore.

2. The two-piece stopper for insertion into a neck of a bottle of claim 1 wherein:

said stopper core is fabricated from one of polytetrafluorethylene, high-density polyethylene and a hard plastic material.

3. The two-piece stopper for insertion into a neck of a bottle of claim 1 wherein:

said stopper sleeve is fabricated from silicone.

4. A two-piece stopper for insertion into a neck of a bottle, comprising:

a stopper core includes a core body, a hole is formed through a length of said core body, a first o-ring groove is formed in a wall of said hole adjacent a top of said stopper core, a second o-ring groove is formed in said wall of said hole adjacent a bottom of said stopper core, a distance between said first and second o-ring grooves is at least twice an outer diameter of said first and second o-ring grooves;

at least one o-ring is inserted into said first and second o-ring grooves; and a stopper sleeve includes an inner diameter and a tapered outer diameter, wherein said stopper core is inserted into said inner diameter, said stopper sleeve is axially retained between said top flange and said sleeve flange.

5. The two-piece stopper for insertion into a neck of a bottle of claim 4 wherein:

a counterbore is formed through said core body, a threaded end of a hose barb is threadably engaged with said counterbore.

6. The two-piece stopper for insertion into a neck of a bottle of claim 4 wherein:

a top flange is formed on a top of said core body, a sleeve flange is formed on a bottom of said core body, said stopper sleeve is retained on said core body between said top flange and said sleeve flange.

7. The two-piece stopper for insertion into a neck of a bottle of claim 4 wherein:

said stopper core is fabricated from one of polytetrafluorethylene, high-density polyethylene and a hard plastic material.

8. The two-piece stopper for insertion into a neck of a bottle of claim 4 wherein:

said stopper sleeve is fabricated from silicone.

* * * * *